US006752323B1

(12) United States Patent
Roos et al.

(10) Patent No.: US 6,752,323 B1
(45) Date of Patent: Jun. 22, 2004

2

(54) HOT MELT MATERIAL APPLICATION SYSTEM WITH HIGH TEMPERATURE PRESSURE MONITORING AND HEATED RECIRCULATING MANIFOLDS

(75) Inventors: John P. Roos, Wakeman, OH (US); Thomas A. Loparo, Elyria, OH (US); William L. Palmer, Lakewood, OH (US); Joseph C. Waryu, Amherst, OH (US); Stephen P. Stewart, Stockton, CA (US); Charles F. Nagy, North Ridgeville, OH (US); Lenzie L. Borders, Cleveland Heights, OH (US); John C. Dillon, Lorain, OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/857,036

(22) PCT Filed: Oct. 29, 1999

(86) PCT No.: PCT/US99/25540

§ 371 (c)(1),
(2), (4) Date: Aug. 23, 2001

(87) PCT Pub. No.: WO00/32318

PCT Pub. Date: Jun. 8, 2000

Related U.S. Application Data

(63) Continuation-in-part of application No. 09/204,809, filed on Dec. 3, 1998, now abandoned.

(51) Int. Cl.[7] ..... B05B 17/04

(52) U.S. Cl. ..... 239/63; 239/135; 222/52; 222/133

(58) Field of Search ..... 239/63, 67, 68, 239/124, 127, 128, 135; 222/52, 133, 63, 56, 57, 145

(56) References Cited

U.S. PATENT DOCUMENTS

| | | | |
|---|---|---|---|
| 4,424,622 | A | 1/1984 | Krause |
| 4,430,886 | A | 2/1984 | Rood |
| 4,527,712 | A | 7/1985 | Cobbs, Jr. et al. |

(List continued on next page.)

FOREIGN PATENT DOCUMENTS

| | | | |
|---|---|---|---|
| EP | 0562888 | A1 | 9/1993 |
| EP | 0819477 | A2 | 1/1998 |

*Primary Examiner*—Michael Mar
*Assistant Examiner*—Thach H Bui
(74) *Attorney, Agent, or Firm*—Calfee, Halter & Griswold, LLP

(57) ABSTRACT

A hot melt high temperature material application system with application device pressure monitoring and heated recirculating manifold uses high temperature pressure transducers with each application device such as spray guns to monitor hot melt material application. A material supply line fitting has a calibrated orifice at the interface with a device manifold associated with each application device. In another embodiment, the calibrated orifice is located in a fluid passageway of the device manifold. The calibrated orifice corresponds in size to the opening of a nozzle of the application device. Heated recirculating manifolds are combined with hot melt material supply systems to provide uniform pressure to multiple application devices, and to recirculate material back through the supply system. Each recirculating manifold includes a heater, pressure regulator, and a recirculation path. The manifolds may be directly or remotely connected to one or more hot melt material supply systems.

25 Claims, 4 Drawing Sheets

U.S. PATENT DOCUMENTS 4,535,919 A * 8/1985 Jameson ..... 222/190
4,545,504 A 10/1985 Fabel et al.
4,602,391 A 7/1986 Shepherd
4,668,948 A 5/1987 Merkel
4,744,330 A 5/1988 Claassen
4,779,762 A * 10/1988 Klein et al. ..... 222/52
4,844,003 A * 7/1989 Slautterback et al. ..... 118/323
5,035,357 A 7/1991 Brickell et al.
5,407,132 A 4/1995 Messerly et al.
5,418,009 A * 5/1995 Raterman et al. ..... 427/207.1
5,481,260 A 1/1996 Buckler et al.
5,495,963 A 3/1996 Miller et al.
5,598,973 A 2/1997 Weston
5,683,036 A * 11/1997 Benecke et al. ..... 239/413
5,862,986 A * 1/1999 Bolyard et al. ..... 239/135
6,170,759 B1 * 1/2001 Meyer ..... 239/298
6,238,484 B1 * 5/2001 Hasegawa ..... 118/302

* cited by examiner

HOT MELT MATERIAL APPLICATION SYSTEM WITH HIGH TEMPERATURE PRESSURE MONITORING AND HEATED RECIRCULATING MANIFOLDS

BACKGROUND

The present application is a continuation-in-part application of U.S. patent application Ser. No. 09/204,809, filed Dec. 3, 1998 now abandoned, which is fully incorporated by reference herein.

The present invention pertains generally to automated materials applications systems and, more particularly, to automated systems adapted for application of hot melt materials which must be heated to high temperatures in order to flow through applications equipment.

Automated material applications systems for hot melt materials typically have a pump which draws material from a reservoir, and directs it through a heated manifold to one or more application devices such as spray guns. The spray guns are controlled or triggered to apply the material to a substrate at a desired rate and pattern. In the case of hot melt materials, i.e., materials which are fluid only at relatively high temperatures, the material must be heated continuously throughout the system in order to insure adequate flow and application. This may be done by heating the material within the reservoir, heating the reservoir directly, using a heated manifold which is connected to the reservoir to preheat the material before it is pumped through a heated line, and attaching a secondary manifold to the gun application device.

In such systems it is helpful to be able to closely monitor and regulate temperature and pressure of the material. In more complex systems with large or multiple reservoirs, and with multiple application devices and separate lines leading to the application devices, monitoring and regulating material temperature and pressure and application rate is more problematic. Non-uniformities in material temperature and pressures throughout the system can produce flaws in the applied coatings. For example, in systems which employ piston pumps to pump material from a reservoir and through a manifold to an applicator such as a spray gun, pressure spikes are created during the power or compression stroke of the pump. This adversely affects the application or distribution of material from the spray gun applicator. The pressure spike problem is compounded if multiple guns are connected to a single manifold of a hot melt unit. Improved systems are needed which perform uniform and consistent material heating from reservoir to spray gun, and which create equal and constant pressures in each of the application devices. Improvements are also needed in the area of monitoring and controlling temperature and pressure for each application device.

SUMMARY OF THE INVENTION

The present invention provides an improved automated system for applying hot melt materials in a continuous manner, wherein hot melt material is uniformly heated and pressurized for controlled application to a substrate, and wherein pressure in each application device is individually monitored. In accordance with one aspect of the invention, there is provided a system for applying hot melt materials in liquid form wherein the materials to be applied must be heated, for example to within an approximate temperature range of 100° F. to 400° F. or greater (also referred to herein generally as "high temperature") and pumped from a reservoir to an application device such as a spray gun. The system includes a hot melt unit having a material pump connected to a material reservoir. The hot melt unit has a manifold with an output connected to an application device such as one or more spray guns. The application device has a material passageway which leads to a nozzle, and a device manifold attached to the body of the application device. The device manifold has a material passageway connected to the material passageway of the application device and connected to an output from the hot melt unit. The device manifold has a sensor cavity, and a pressure sensor in the sensor cavity operative to sense pressure of material flowing through the device manifold and the application device. A heated recirculating manifold is connected to the hot melt unit and to the application device in such a manner that material pumped from the hot melt unit passes through the heated recirculating manifold prior to reaching the application device. The heated recirculating manifold has a manifold body with a material passageway, an entry port to the material passageway connected to an output of the hot melt unit, an exit port from the material passageway connected to the application device, a recirculating exit port for the material passageway connected to the hot melt unit, a heating element in thermal communication with the body of the manifold, a pressure regulator associated with the material passageway between the entry port and exit port, and a recirculation control valve associated with the material passageway and the recirculation exit port.

These and other aspects of the invention are further described herein in detail with reference to the accompanying Figures.

DETAILED DESCRIPTION OF PREFERRED AND ALTERNATE EMBODIMENTS OF THE INVENTION

Figure 1:
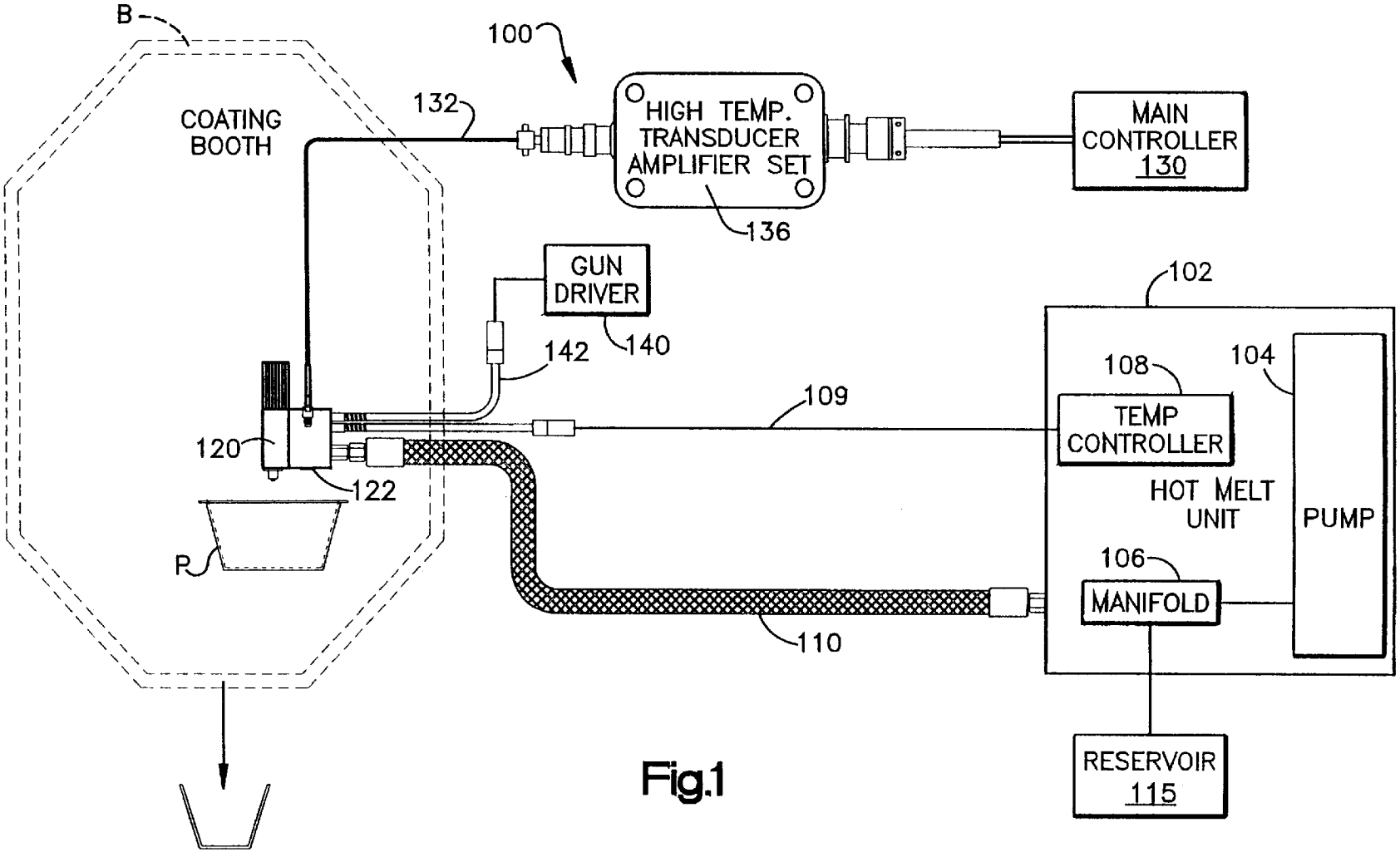
FIG. 1 is a schematic diagram of a hot melt material application system of the present invention.

FIG. 1 schematically illustrates an automated hot melt material application system, indicated generally at 100. The system 100 includes a hot melt unit 102, which may be, for example, a Nordson Series 3000 product. The hot melt unit functions in part to heat a material to be applied to within an approximate temperature range of 100° F. to 400° F. or greater, which is defined herein as "high temperature". The hot melt unit 102 includes a pumping device 104 which may be a gear pump or piston pump connected to pump hot melt material from a reservoir 115 to a heated manifold 106. Material exits from the manifold 106 through a heated hose 110. The heated hose 110 runs from the hot melt unit 102 to one or more application devices 120, which may be for example a controlled spray gun, such as a Nordson E-201 spray gun, or any other type of suitable material application device. In a typical automated applications system, the application devices are located within a chamber or booth B through which parts P to be coated are passed by a conveyor. Attached to the application device 120 is a device manifold 122, which is preferably a heated manifold when used with a hot melt material. The application device 120 and device manifold 122 are sometimes referred to collectively herein as the "gun" or "gun assembly" or "application device". A temperature controller 108 of the hot melt unit 102 is connected by line 109 to the device manifold 122.

A main controller 130, connected to the application devices 120 by line 132, functions to monitor the state of each of the application devices 120, including such parameters as temperature, pressure, duration and timing of on and off conditions, and flow states (e.g. clogged, unclogged) of spray nozzles on the application devices. This type of application device system monitoring is described in U.S. Pat. Nos. 4,430,886 and 5,481,260, the disclosures of which are incorporated herein by reference. A gun driver 140 is connected by line(s) 142 to each of the application devices 120. The gun driver 140 functions to control operational states of the application devices 120 as is known in the art.

Figure 2:
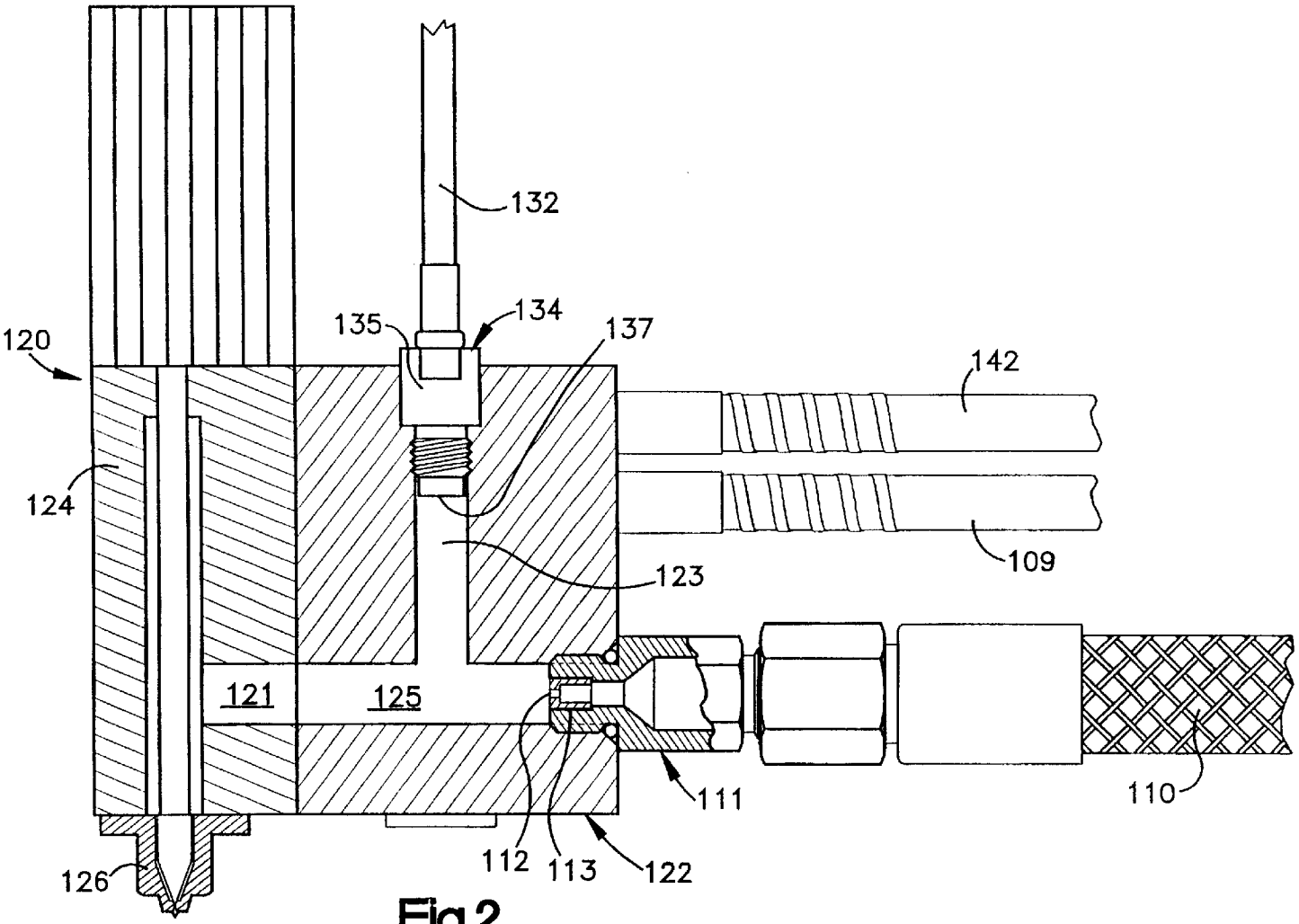
FIG. 2 is a cross-sectional view of a spray gun material application device and associated connections of the present invention.
Figure 2A:
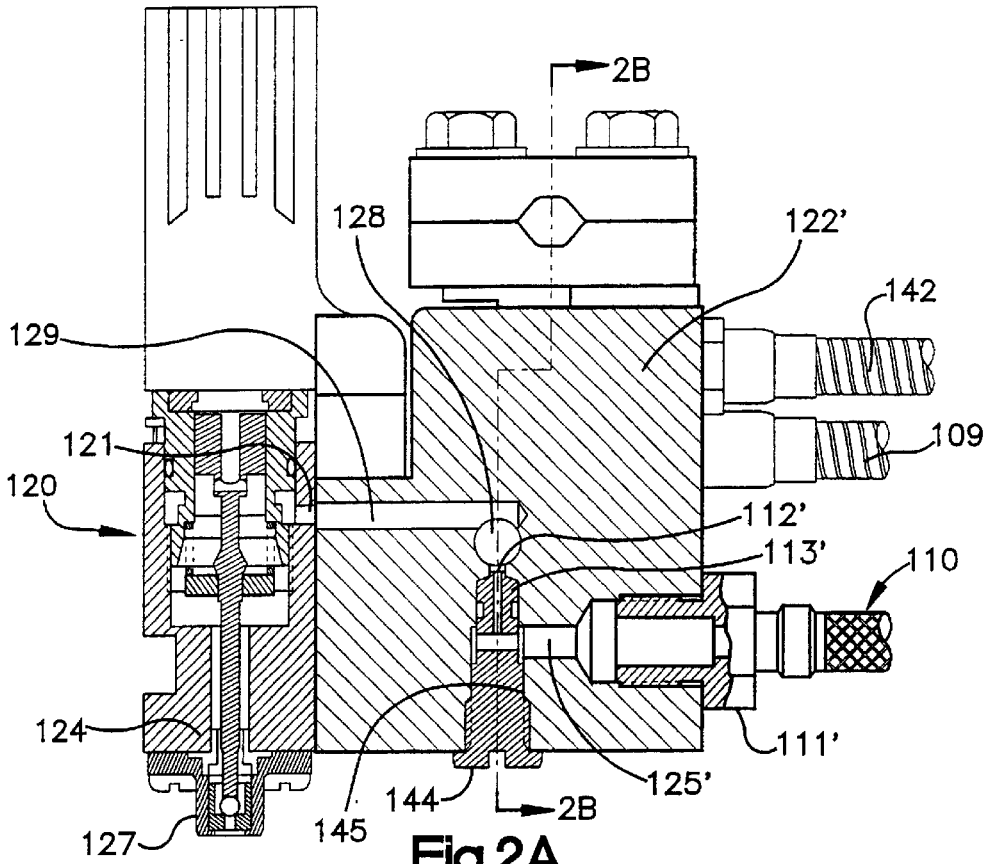
FIG. 2A is an alternative embodiment of the cross-sectional view of the spray gun material application device and associated connections of FIG. 2.
Figure 2B:
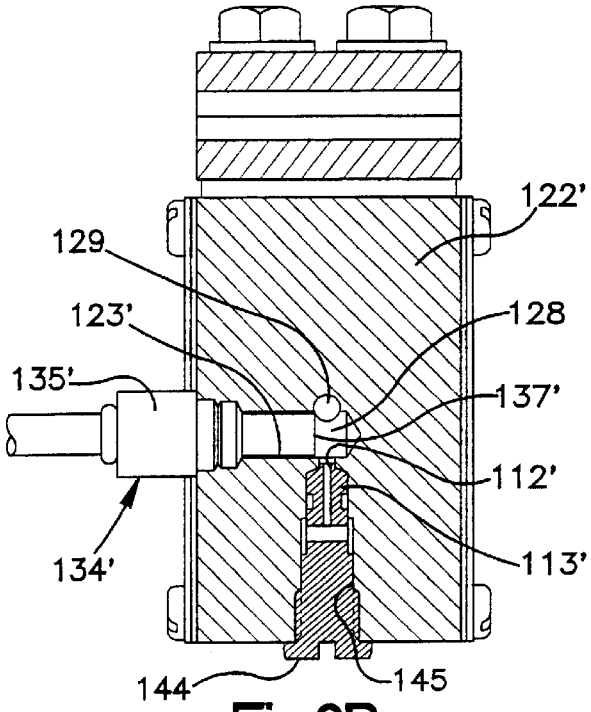
FIG. 2B is a part cross-sectional view of the FIG. 2A embodiment taken along section line 2B—2B.

As shown in FIG. 2, a sensor, such as a high temperature pressure transducer 134 is operatively connected to or otherwise attached or physically associated with the device manifold 122, also referred to herein as a "heated element" or "heated manifold". In this particular embodiment, the transducer 134 includes a sensing face 137 and a fitting 135 which is thread-engaged in an opening or sensor cavity 123 in manifold 122 (an alternative embodiment for the mounting and location of transducer 134 in manifold 122 is shown in FIGS. 2A and 2B and further described below). Cavity 123 communicates with passageway 125. In the FIG. 2 embodiment, the sensing element or sensing face of the transducer 137, is recessed in cavity 123 relative to passageway 125. Hose 110 includes a fitting 111 which is connected to an opening or intake/entry port to passageway 125. A feeder passageway 121 in the body 124 of application device 120 is aligned with passageway 125.

A calibrated orifice 112 in an orifice plate 113 within heated hose fitting 111 causes a change in pressure, such as for example, a pressure drop in material as it flows through passageway 125 of the device manifold 122 into passageway 121 in gun body 124, and ultimately to the gun nozzle 126. Alternatively, the passageway 125 in the device manifold 122 may be configured to include a calibrated orifice across which a pressure change is created (see FIGS. 2A and 2B, for example, and description, below). The pressure change is converted by the transducer 134 to a voltage which is amplified by amplifier 136 and sent to the main controller 130. The main controller 130 may be programmed to compare the pressure readings from transducer 134 to a range of control parameters in order to identify readings which are out of the range. A display associated with the main controller 130 can then alert an operator of a discrepancy in the hydraulic operation of the system, which could adversely affect the material application process. The orifice in fitting 111 is matched to the size of nozzle 126 for desired flow rates through the gun. For different flow rates as required for application of different types of hot melt materials, the fitting 111 is adapted to be interchangable with fittings of different size orifices.

Referring now to FIGS. 2A and 2B, a sensor, such as a high temperature pressure transducer 134' is similarly operatively connected to, or otherwise attached or physically associated with, the heated device manifold, or "device manifold" or heated manifold" 122'. In this embodiment, the transducer 134' includes a fitting 135' which is thread-engaged, or otherwise mounted, such as press fit with a retainer or clip (not shown), in an opening or sensor cavity 123' in device manifold 122'. Sensor cavity 123' communicates with fluid chamber 128 so that sensing face 137' of transducer 134' can sense the pressure of the fluid proximate the calibrated orifice 112'. In this embodiment, fluid material enters hose 110 which is attached to device manifold 122' via fitting 111' (which, in this embodiment does not contain the calibrated orifice 112'). The fluid path through device manifold 122' is as follows: fluid material enters passageway 125', flows through orifice 112' in orifice plate 113', discharges from orifice 112' into a fluid chamber 128 (where it is sensed by sensing face 137' of transducer 134'), and flows into application device 120 via fluid passageway 129. This is in contradistinction to the generally straight fluid passageway 125 shown in the FIG. 2 embodiment. In the FIG. 2 embodiment, the sensing face 137 of the transducer 134, is recessed substantially in cavity 123 relative to passageway 125. In this embodiment shown in FIGS. 2A and 2B, the sensing face 137' of transducer 134' is much closer to passageway 125' than in the FIG. 2 embodiment. By placing the sensing element 137' proximate the fluid flow path as shown in FIG. 2B (or substantially flush with an inner wall defining the fluid flow path), transducer face 137' is constantly washed by the flow stream of moving hot melt fluid material, which improves sensitivity and performance of the system. Whether transducer face 137' is substantially flush with an inner wall of the fluid passageway or is slightly recessed from the flow path, of from 0 inches up to about 0.25 inches, or even slightly more, sensor face 137' will be subjected to a constant washing of moving hot melt fluid material. Again, the important performance aspect is to insure that whatever the position of sensor face 137' with respect to the passageway 125', the fluid flow of hot melt material through the fluid passageway constantly washes, or replenishes hot melt fluid to be sensed, across sensor face 137'. This increases sensitivity and performance of the system. In addition, a plug or screw 144 is operatively associated with manifold 122' in this embodiment. The addition of plug 144 creates an access port 145 in manifold 122' to access and service the calibrated orifice 112' and calibrated orifice plate 113' held inside. In the illustrated embodiment, plug 144 is a screw plug threadbly connected to device manifold 122', however, other configurations would work and are within the scope of this invention, such as a press fit plug with retainer arrangement (not shown).

A calibrated orifice 112' in an orifice plate 113' within the passageway 125' in the device manifold 122' creates a pressure change. The pressure change is converted by the transducer 134' to a voltage, as described above for the FIG. 2 embodiment. The orifice 112' in orifice plate 113' has precise tolerances and is similarly matched to the size of nozzle (not shown in FIG. 2A, but would be mounted at the end of valve 127 to communicate with material through valve 127, such as nozzle 126 shown in FIG. 2) for desired flow rates through the gun as described above for the FIG. 2 embodiment. Thus, depending on the type of hot melt material provided by hose 110, the orifice plate 113' with corresponding orifice 112' and nozzle (such as 126 in FIG. 2) would be selected to achieve the desired material flow rates.

Referring again to FIG. 1, the manifold 106 associated with the hot melt unit 102 heats material prior to transfer through hose or hoses 110 connected to the application devices 120. In hot melt units such as the Nordson 3000, which may typically have only one or two application devices connected to the unit, the manifold 106 has only one or two outlet ports (connectable to for example hose 110) and a single fluid connection to the material reservoir 115.

Figure 4:
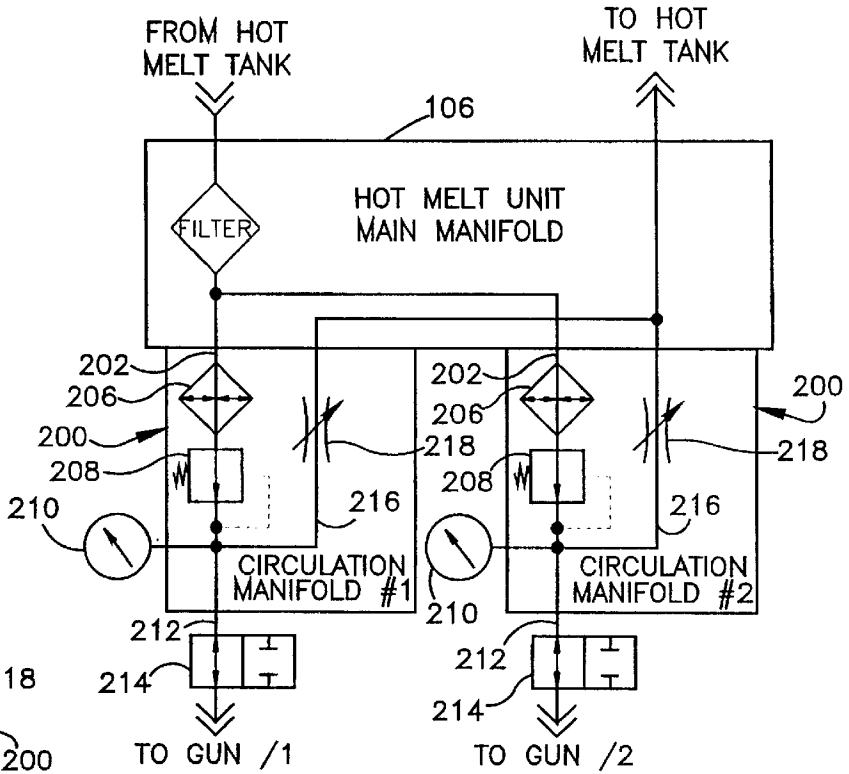
FIG. 4 is a schematic diagram of an alternate embodiment of an automated material application system which includes spray pressure control heated recirculating manifolds of the present invention.
Figure 3:
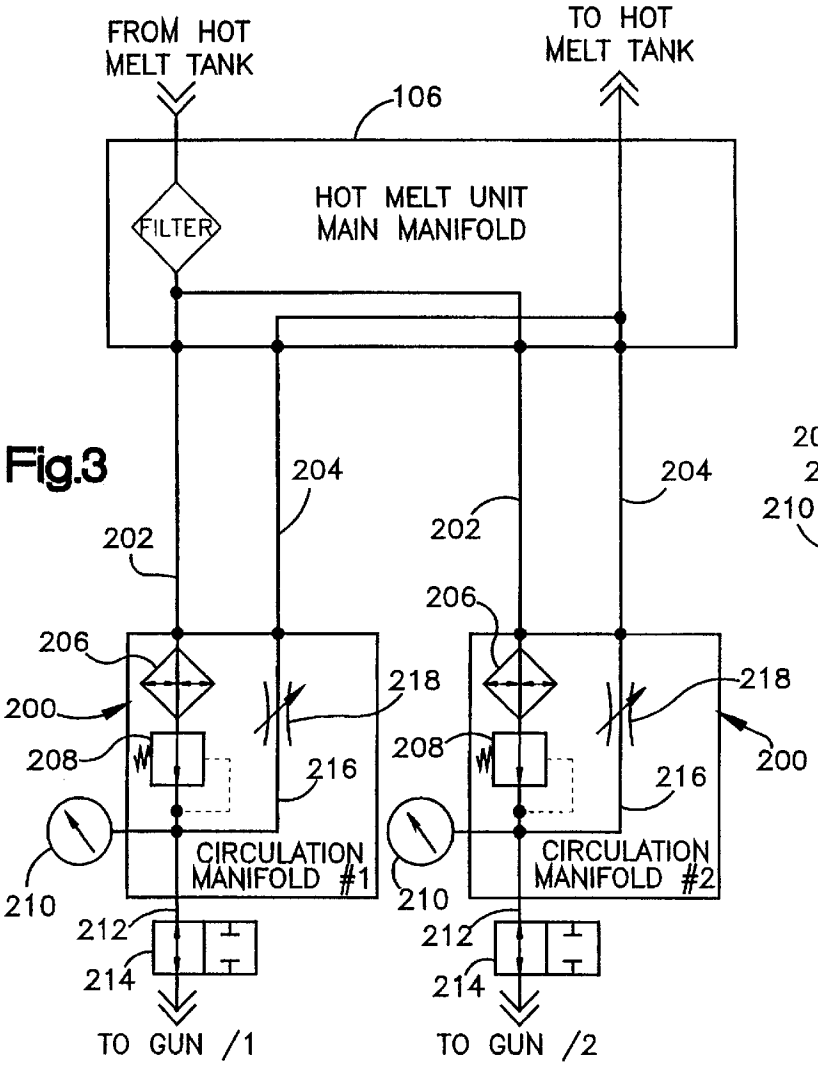
FIG. 3 is a schematic diagram of an automated material application system which includes spray pressure control heated recirculating manifolds of the present invention.

As schematically shown in FIGS. 3 and 4, the invention further includes one or more remote or secondary manifolds 200, also referred to herein as heated recirculation manifolds, fluidly connected by heated intake lines 202 and exhaust lines 204 to the main manifold 106 of the hot melt unit 102 described with reference to FIG. 1. The remote or secondary manifolds 200 are preferably heated manifolds which include internal fluid circuits, each with a cartridge heater 206 which may include an RTD and wiring box, a flow regulator 208, a pressure gauge 210 operatively connected to the internal circuit, and an output line 212 connectable to an application device such as a spray gun, such as spray gun 120 described with reference to FIG. 1. A shut-off valve 214 may be provided in the output line 212 between the secondary manifold 200 and an application device. The internal circuit of the manifold 200 further includes a circulation or recirculation path 216 with valve 218, connected to line 204 which returns the main manifold 106, and exiting the main manifold to a material reservoir.

In operation, fluid enters the secondary manifold 200 from the main manifold 106, passes heater 206 and is pressure regulated by regulator 208, and passes through valve 214 to a spray gun or other application device. Fluid which does not go the gun is circulated within the manifold 200 and directed through valve 218 and line 204 to the hot melt unit, and recirculated back to the main reservoir 115.

The manifolds 200, when combined with multiple gun/applicator setups wherein a separate manifold is in fluid communication with each gun/applicator, perform at least four different functions which include:

1. independent fluid pressure regulation and pressure read-out of one or more spray guns;

2. consistent pressure control to the spray guns with either piston or gear pump type hot melt units;

3. recirculation of fluid back to the hot melt unit and associated reservoir, and 4. independent recirculation rates back to the hot melt unit in multiple gun/applicator setups.

Also, because the pressure regulation is discrete among each gun/applicator in such a setup, individual gun pressure monitoring, such as described in U.S. Pat. Nos. 4,430,886 and 5,481,260, the disclosures of which are incorporated herein by reference, is facilitated by the secondary manifolds 200. For example, by providing separate adjustment/setting controls for each of the pressure regulators 208 in each of the manifolds 200, the spray pressure of the associated gun/applicator can be individually and precisely controlled. Similarly, the heating temperature of each of the heaters 206 of the manifolds 200 can be separately controlled, either through controls of the hot melt unit 106, or through separate controls.

The secondary manifolds 200 may be physically located proximate or closely proximate to the main manifold 106 of the hot melt unit 102 as shown in FIG. 4, or remotely located and fluidly connected by heated hoses as shown in FIG. 3.

The invention as thus described provides an improved system for automated temperature and pressure controlled application of hot melt and other materials which must be heated during the application process. The high temperature pressure transducer in connection with the application devices provides accurate real-time data on the flow of material through each of the guns. The secondary recirculating manifolds provide independent fluid pressure regulation and pressure read-outs for each gun or application device; consistent pressure control to each of the gun/application devices whether the hot melt unit is driven by a piston or gear pump; recirculation of material back to the hot melt unit and associated reservoir, and individual gun/applicator pressure and temperature control and monitoring.

What is claimed is:

1. A system for supplying heated material and applying it to a substrate, wherein the system includes a hot melt unit which heats and supplies material from a material reservoir through at least one material output line, each said material output line being connected to a device manifold, each said device manifold being connected to a material application device, each said device manifold having a material flow passage therethrough; each said device manifold including a flow restricting orifice disposed in said material flow passage and a pressure transducer disposed between said orifice and said material application device, said heated material flowing from said material output line and through said orifice of said device manifold past said pressure transducer and into said material application device, said transducer having a sensing face exposed to the flow of said heated material for sensing the pressure of the heated material in said material flow passage and producing an output indicative of the pressure therein, said heated material being applied by said material application device to said substrate.

2. The system of claim 1 further comprising at least one heated recirculating manifold, each said heated recirculating manifold in fluid communication between said material reservoir and at least one said at least one material output line, said heated recirculating manifold having a recirculation line and a pressure relief valve for each said material output line, each said recirculation line being connected to said reservoir of said hot melt unit through said pressure relief valve.

3. The system of claim 2 wherein each said heated recirculating manifold further comprises a heater and a pressure regulator.

4. The system of claim 3 wherein each said heated recirculating manifold supplies heated material through two material output lines.

5. The system of claim 1 wherein said sensing face of each said pressure transducer is substantially directly exposed to the flow of said heated material within a flow passage through said device manifold for said heated material.

6. The system of claim 1 wherein said sensing face of each said pressure transducer is substantially flush with a flow passage through said device manifold for said heated material.

7. The system of claim 1 wherein each of said material application devices has a nozzle and each of said flow restricting orifices has an orifice through which said heated material flows, and wherein said nozzles are selected based on the size of said orifices.

8. The system of claim 3 wherein said pressure regulator in said heated recirculating manifold provide independent control of the pressure of said heated material in said material output lines.

9. The system of claim 1 wherein each of said device manifolds includes a heater to apply heat to said heated material flowing through said device manifolds, said device manifold heaters providing independent control of the temperature of said heated material flowing from said device manifolds into said material application devices.

10. The system of claim 9 wherein said pressure regulators in said at least one heated recirculating manifold provide independent control of the pressure of said heated material in said material output lines.

11. The system of claim 10 wherein each of said pressure transducers has a face which is substantially flush with a flow passage through said device manifolds for said heated material.

12. The system of claim 11 wherein each of said material application devices has a nozzle and each of said flow restricting orifices has an orifice through which said heated material flows, and wherein said nozzles are selected based on the size of said orifices.

13. The system of claim 2 wherein at least two heated recirculating manifolds are provided, each of said the heated recirculating manifolds supplying heated material through at least one said material output line.

14. A material application system for supplying heated material to a substrate, comprising a heated recirculating manifold and a hot melt unit which heats and supplies material from a material reservoir to at least one application device, the heated recirculating manifold adapted to be installed in a fluid circuit with the hot melt unit and the application device, the heated recirculating manifold comprising:

a manifold body having a material passageway, an entry port to the material passageway adapted to be connected to an output of the hot melt unit, an exit port from the material passageway adapted to be connected to an input of an application device, a recirculating exit port from the material passageway adapted to be connected to the hot melt unit, a heating element in thermal communication with the body of the manifold, a pressure regulator disposed in the material passageway between the entry port and exit port, and a recirculation control valve associated with the material passageway and the recirculation exit port.

15. The heated recirculating manifold of claim 14 in combination with a shut-off valve located in a fluid connection between the manifold and the application device.

16. The heated recirculating manifold of claim 14 in combination with a pressure regulator operatively connected to the material passageway of the manifold.

17. The heated recirculating manifold of claim 14 in combination with a hot melt unit, wherein a connection extends from the recirculation exit port of the manifold to the hot melt unit and to a material reservoir associated with the hot melt unit.

18. The heated recirculating manifold of claim 14 attached to a manifold of a hot melt unit.

19. The heated recirculating manifold of claim 14 connected to a hot melt unit by a heated hose.

20. The heated recirculating manifold of claim 14 in combination with a single hot melt unit and at least one other heated recirculating manifold.

21. The system of claim 14 further comprising a device manifold for each said material application device, each said device manifold being connected to one of said at least one material application device, each said device manifold including a flow restricting orifice and a pressure transducer, said heated material flowing from said hot melt unit through said orifice of said device manifold and into said material application device for application to the substrate.

22. The system of claim 21 wherein each said pressure transducer has a face which is substantially flush with a flow passage through said device manifold for said heated material.

23. The system of claim 21 wherein each said material application device has a nozzle and said flow restricting orifice has an orifice through which said heated material flows, and wherein said nozzle is selected based on the size of said orifice.

24. The system of claim 16 wherein said pressure regulator in said heated recirculating manifold provides independent control of the pressure of said heated material in said system between said recirculating manifold and said application device.

25. The system of claim 21 wherein each said device manifold includes a heater to apply heat to said heated material flowing through said device manifold, said device manifold heater providing independent control of the temperature of said heated material flowing from said device manifold into said material application device.

* * * * *